US012768356B2

(12) United States Patent
Yakushiji et al.

(10) Patent No.: US 12,768,356 B2
(45) Date of Patent: Oct. 20, 2026

(54) COMPRESSOR-ADAPTED ENCLOSURE AND COMPRESSOR UNIT

(71) Applicant: MITSUBISHI HEAVY INDUSTRIES, LTD., Tokyo (JP)

(72) Inventors: Shunsuke Yakushiji, Tokyo (JP); Yasunori Watanabe, Tokyo (JP); Takayuki Hagita, Tokyo (JP)

(73) Assignee: MITSUBISHI HEAVY INDUSTRIES, LTD., Tokyo (JP)

( * ) Notice: Subject to any disclaimer, the term of this patent is extended or adjusted under 35 U.S.C. 154(b) by 0 days.

(21) Appl. No.: 19/128,568

(22) PCT Filed: Sep. 28, 2023

(86) PCT No.: PCT/JP2023/035526

§ 371 (c)(1),
(2) Date: May 9, 2025

(87) PCT Pub. No.: WO2024/116587

PCT Pub. Date: Jun. 6, 2024

(65) Prior Publication Data

US 2026/0226899 A1 Aug. 6, 2026

(30) Foreign Application Priority Data

Dec. 2, 2022 (JP) ..... 2022-193642

(51) Int. Cl.
*F04C 29/06* (2006.01)
*F04C 18/02* (2006.01)
(Continued)

(52) U.S. Cl.
CPC ..... *F04C 29/068* (2013.01); *F04C 18/0215* (2013.01); *F04B 39/121* (2013.01);
(Continued)

(58) Field of Classification Search
CPC .... F04C 29/066; F04C 29/068; F04D 29/663; F04D 29/664; F04B 53/001; F24F 1/12; F24F 2013/202; F24F 2013/242
See application file for complete search history.

(56) References Cited

U.S. PATENT DOCUMENTS 8,950,208 B2 * 2/2015 Bae ..... F24F 1/08 62/295
12,110,910 B2 * 10/2024 Watanabe ..... F01C 21/10
(Continued)

FOREIGN PATENT DOCUMENTS

JP 2012202377 A 10/2012
JP 5609736 B2 10/2014
(Continued)

*Primary Examiner* — Courtney D Heinle
*Assistant Examiner* — Behnoush Haghighian
(74) *Attorney, Agent, or Firm* — Osha Bergman Watanabe & Burton LLP

(57) ABSTRACT

A compressor-adapted enclosure includes: a main body configured to accommodate and enclose a compressor in the main body; and a plurality of protruding parts protruding from an inner face of the main body, the plurality of protruding parts being in contact with the compressor. The main body is rigid to the degree that the main body bends under its own weight. The protruding parts are more provided at positions corresponding to an electric motor unit of the compressor than at positions corresponding to a compressing unit of the compressor.

6 Claims, 4 Drawing Sheets

(51) Int. Cl.
*F04B 39/12* (2006.01)
*F04D 29/66* (2006.01)
*F24F 1/12* (2011.01)

(52) U.S. Cl.
CPC ..... *F04C 29/066* (2013.01); *F04C 2240/30* (2013.01); *F04D 29/663* (2013.01); *F04D 29/664* (2013.01); *F24F 1/12* (2013.01)

(56) References Cited

U.S. PATENT DOCUMENTS

2012/0167608 A1* 7/2012 Bae ..... F24F 1/08
62/296
2012/0251357 A1* 10/2012 Yokoi ..... F04B 53/16
417/410.1
2022/0170484 A1* 6/2022 Watanabe ..... F01C 21/10

FOREIGN PATENT DOCUMENTS

JP 2020007975 A 1/2020
WO 2020195547 A1 10/2020

* cited by examiner

COMPRESSOR-ADAPTED ENCLOSURE AND COMPRESSOR UNIT

TECHNICAL FIELD

The present disclosure relates to a compressor-adapted enclosure that accommodates a compressor therein and a compressor unit.

BACKGROUND ART

As compressors used for a refrigeration cycle for air conditioning of electric vehicles and hybrid vehicles, electric compressors are used. An electric compressor is configured to drive, by an electric motor, a compressing unit including a scroll mechanism or the like. Since the electric compressor is operated upon a request for air conditioning even when the vehicle is stopped, a further reduction of noise is required. To reduce noise, an enclosure that accommodates and covers a compressor therein as with Patent Literature 1 is proposed.

CITATION LIST

Patent Literature

[PTL 1]
Japanese Patent Application Laid-Open No. 2012-202377

SUMMARY OF INVENTION

Technical Problem

Since the compressor-adapted enclosure of Patent Literature 1 encloses the entire compressor, noise can be suppressed. Since a main body of the enclosure is made of a rigid resin such as polypropylene (PP), however, there is a problem of the main body easily transferring vibrations of the compressor.

Further, the compressor-adapted enclosure of Patent Literature 1 not only accommodates the compressor but also includes an installation leg part for installing the compressor on the vehicle side, and there are problems of complex structure and increased costs.

The present disclosure has been made in view of such circumstances and intends to provide a compressor-adapted enclosure and a compressor unit that have a simple configuration and can suppress noise generated by the compressor.

Solution to Problem

A compressor-adapted enclosure according to one aspect of the present disclosure includes: a main body configured to accommodate and enclose a compressor in the main body; and a plurality of protruding parts protruding from an inner face of the main body, the plurality of protruding parts being in contact with the compressor, and the main body is rigid to the degree that the main body bends under its own weight.

A compressor unit according to one aspect of the present disclosure includes: the compressor-adapted enclosure described above; and a compressor accommodated in the compressor-adapted enclosure.

Advantageous Effects of Invention

Noise generated by a compressor can be suppressed with a simple configuration.

DESCRIPTION OF EMBODIMENTS

An embodiment according to the present disclosure will be described below with reference to the drawings.

Figure 1:
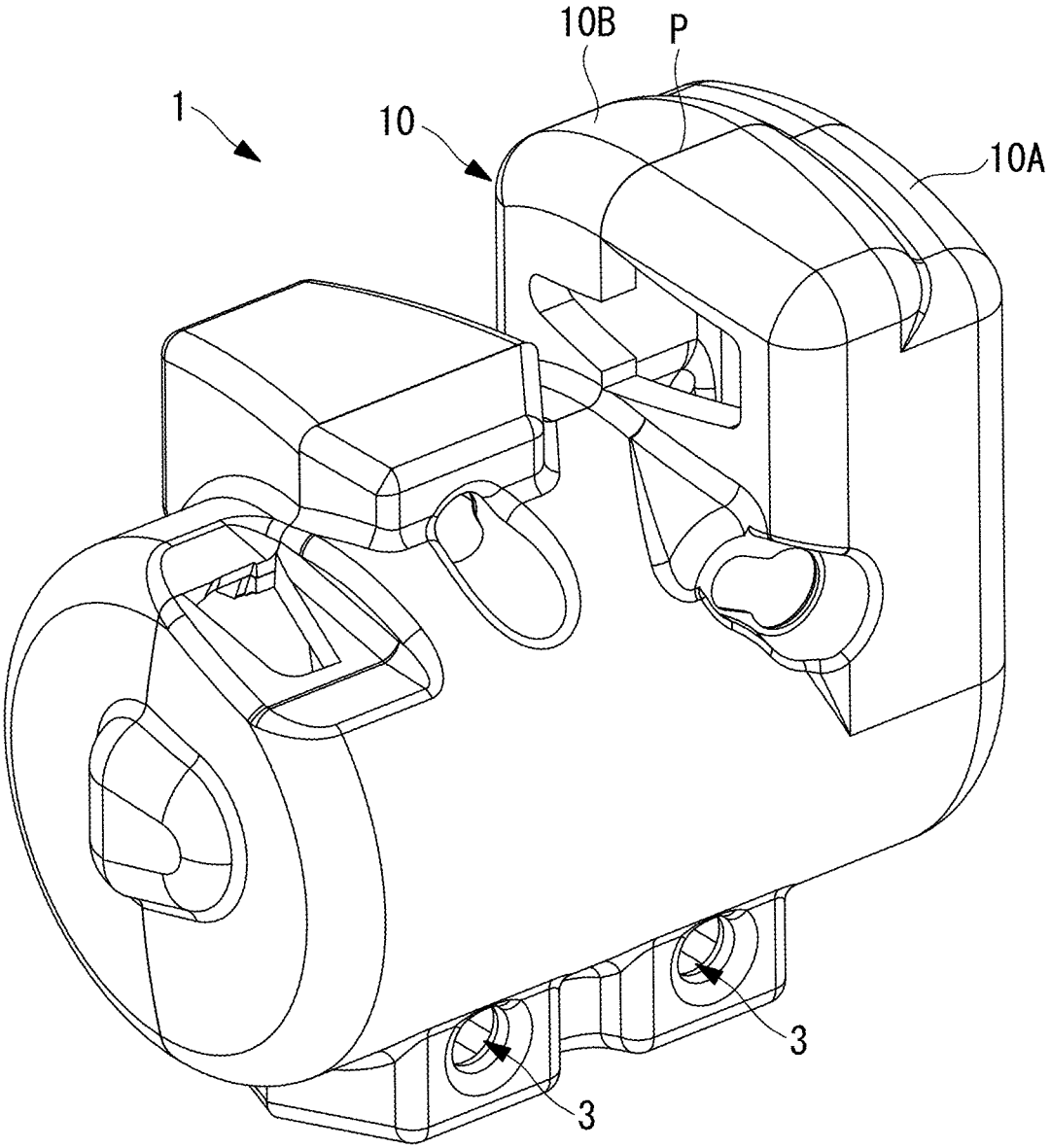
FIG. 1 is a perspective view illustrating a compressor-adapted enclosure according to one embodiment of the present disclosure.

FIG. 1 illustrates an enclosure 1 entirely covering an electric compressor. A main body 10 of the enclosure 1 has a shape corresponding to the external shape of the electric compressor and is divided into two halves (divided bodies) 10A, 10B laterally by a dividing plane P.

When installation leg parts 3 of the compressor are located downward, the dividing plane P is provided extending in the vertical direction. The installation leg parts 3 of the compressor are fixing parts for installing the compressor to fixing parts on the vehicle side. In such a way, the compressor is fixed to a vehicle by the installation leg parts 3 provided to the compressor and is not fixed to a vehicle by utilizing the rigidity of the enclosure 1.

The main body 10 of the enclosure 1 is rigid to the degree that the main body 10 bends under its own weight and is made of a foaming resin material such as a foamed urethane (flexible PUR foam), for example. Therefore, the enclosure 1 is softer than a rigid plastic material such as polypropylene (PP) and polybutylene terephthalate (PBT).

The left and right halves 10A, 10B can be fixed to each other using various fixing methods, for example, engagement or the like using bolts and nuts, claws, or the like is used.

Figure 2:
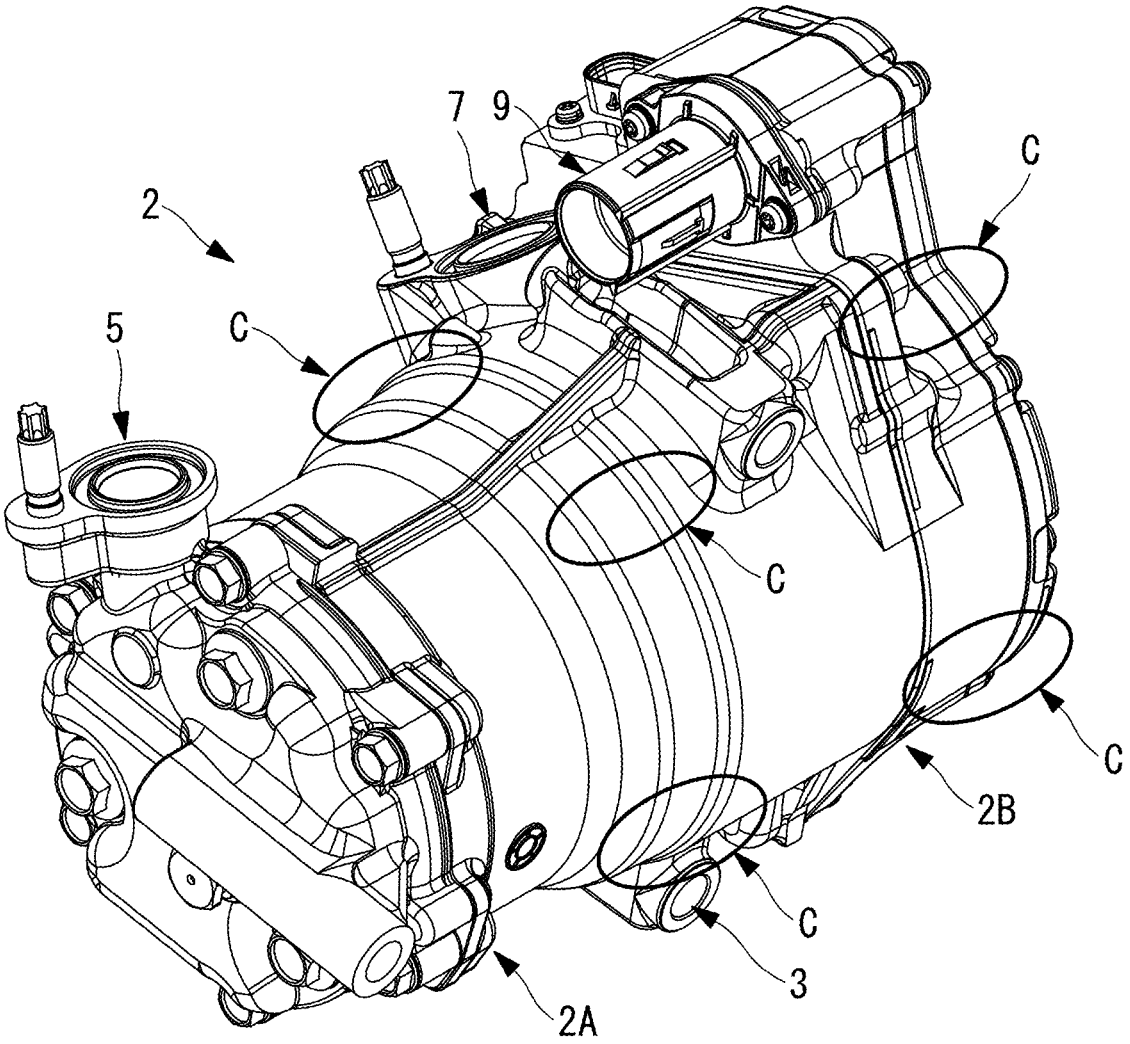
FIG. 2 is a perspective view illustrating a compressor according to one embodiment of the present disclosure.

FIG. 2 illustrates a compressor 2. The compressor 2 illustrated in FIG. 2 does not have a shape that exactly matches the enclosure 1 illustrated in FIG. 1, for example, in terms of the number of installation leg parts 3 or the like, but this makes little difference in the description of the compressor that is sound-insulated by the enclosure 1. That is, the enclosure 1 according to the present embodiment can be widely applied to any compressors having the configuration described below.

The compressor 2 forms a part of a refrigeration cycle used for air conditioning of a vehicle, takes in a refrigerant guided from an evaporator and then compresses the refrigerant, and discharges the compressed refrigerant to a condenser. The compressor 2 has a substantially circular cylindrical shape having a longitudinal axis in the horizontal direction as illustrated in FIG. 2. The compressor 2 is an electric compressor and includes a compressing unit 2A having a scroll mechanism and a motor unit (electric motor unit) 2B having an electric motor for driving the scroll mechanism.

The compressing unit 2A is located on the front side of the compressor 2 (the left side in FIG. 2) and includes a fixed scroll and a swirl scroll therein. Since the swirl scroll orbits while being in partial contact with the fixed scroll, the compressing unit 2A mainly serves as a vibration source or a noise source of the compressor 2. A cylindrical discharge port (extension part) 5 for discharging a compressed refrigerant is provided at the top of the compressing unit 2A.

The motor unit 2B is connected to the rear of the compressing unit 2A and is located on the rear side of the compressor 2 (the right side in FIG. 2). The motor unit 2B includes an electric motor having a stator and a rotator, and an inverter unit for supplying power to the electric motor. The diameter of the motor unit 2B is larger than the diameter of the compressing unit 2A. A cylindrical intake port 7 for taking the refrigerant in the compressor 2 is provided at the top of the motor unit 2B. Moreover, a cylindrical wiring guide cylinder (extension part) 9 for guiding a harness of a power cable, a signal line, or the like to the outside of the compressor 2 is provided at the top of the motor unit 2B and near the intake port (extension part) 7.

Figure 3:
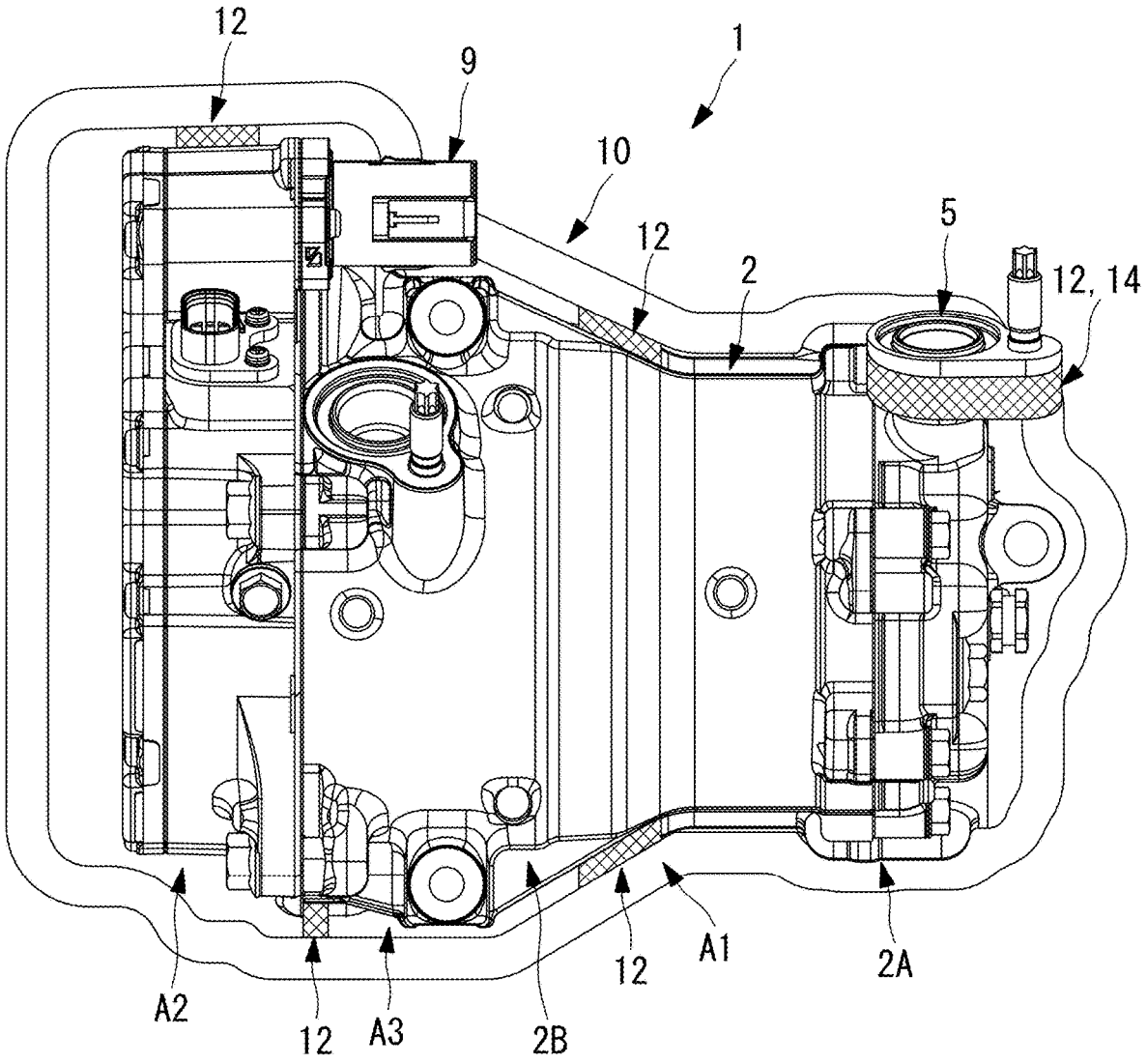
FIG. 3 is a longitudinal sectional view illustrating the enclosure according to one embodiment of the present disclosure in which the compressor is accommodated.

FIG. 3 illustrates a longitudinal sectional view of a state where the enclosure 1 is installed to the compressor 2 of FIG. 2. Note that, in FIG. 3, the view is laterally inverted from the compressor 2 illustrated in FIG. 2, and the compressing unit 2A is located on the right side and the motor unit 2B is located on the left side. That is, FIG. 3 is a longitudinal sectional view of FIG. 2 when viewed from the back side.

As illustrated in FIG. 3, the main body 10 of the enclosure 1 accommodates and encloses the entire compressor 2 therein. With a clearance of about 5 mm to 20 mm being provided between the main body 10 and the compressor 2, the main body 10 is in contact with the compressor 2 via the protruding parts 12 at multiple positions. The protruding parts 12 each have a projecting shape protruding from the inner face of the main body 10, and the tips of the protruding parts 12 are in contact with the outer face of the compressor 2. Since the material of the main body 10 is rigid to the degree that the main body 10 bends under its own weight, the shape of the main body 10 is maintained by the protruding parts 12 arranged at respective positions. The protruding parts 12 are preferably made of a softer material than the material of the main body 10, for example, a rubber sponge such as ethylene-propylene-diene rubber (EPDM) foam material of EPTSEALER (registered trademark) or the like, open-cell foam polyethylene, or the like can be used. The protruding parts 12 are fixed by adhesion or the like to the inner face of the main body 10.

The protruding parts 12 are provided mainly on the motor unit 2B of the compressor 2. More specifically, the protruding parts 12 are provided at a front end part A1, a rear end part A2, and a middle part A3 therebetween of the motor unit 2B, respectively. Note that the protruding parts 12 of the middle part A3 can be omitted as appropriate. Further, the protruding parts 12 are provided at multiple positions in the circumferential direction of the compressor 2. For example, as illustrated by the arrow C in FIG. 2, the protruding parts 12 are provided on the lower side and the upper side of the compressor 2, respectively. As with the present embodiment, it is preferable to provide more protruding parts 12 to the motor unit 2B than to the compressing unit 2A.

At a position corresponding to the discharge port 5, a hole is formed in the main body 10 so that the discharge port 5 is inserted therethrough. To fill the gap between the edge of the hole and the side circumferential face of the discharge port 5, a seal member 14 is provided as the protruding parts 12 as illustrated in FIG. 3. The seal member 14 is arranged so as to wrap around the outer circumferential of the cylindrical part of the discharge port 5.

Figure 4:
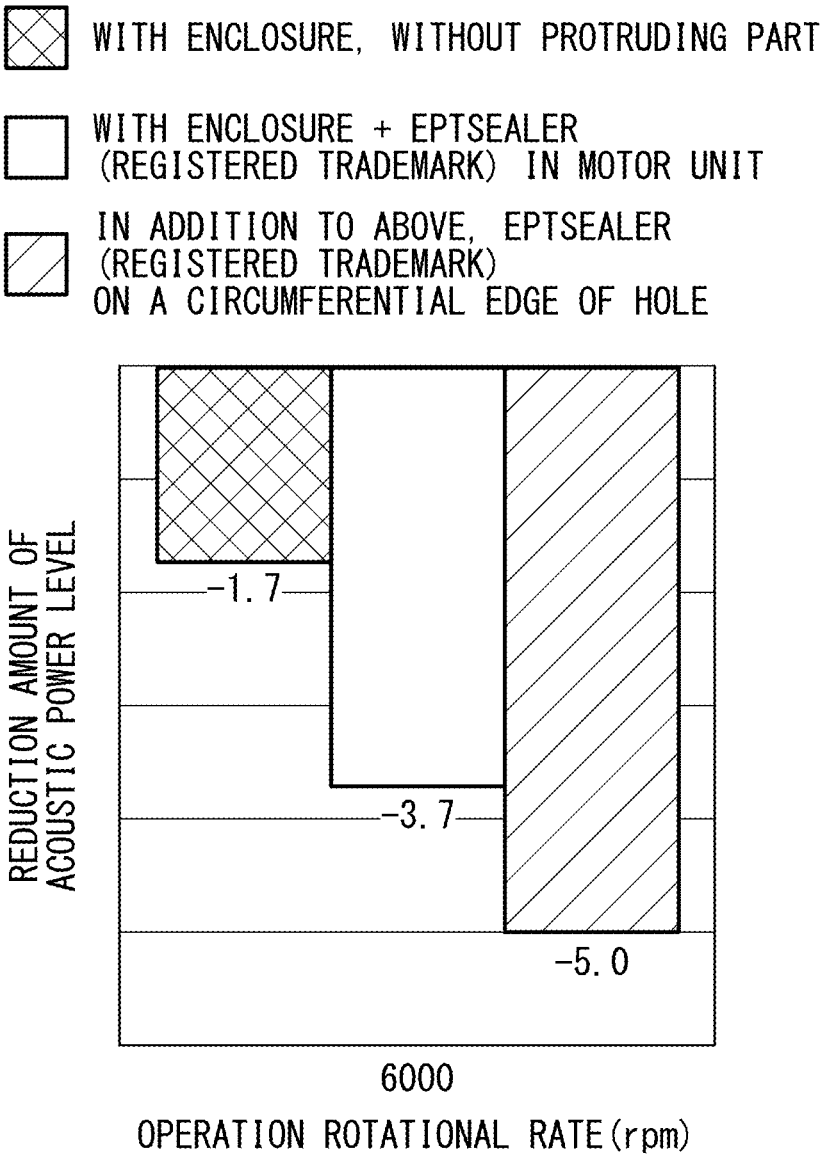
FIG. 4 is a graph illustrating a noise reduction effect.

FIG. 4 illustrates experiment results about a noise reduction effect when the enclosure 1 of the present embodiment is used. The noise was measured at frequencies from 0 to 10 kHz when the rotational rate of the compressor 2 was set to 6000 rpm.

As is clear from FIG. 4, when the main body 10 of the enclosure 1 of the present embodiment is used and the protruding parts 12 are not used, a noise reduction by 1.7 decibel (dB) was obtained compared to a case where no enclosure is installed. In addition, as illustrated in FIG. 3, when the plurality of protruding parts 12 are provided in the motor unit 2B and EPTSEALER (registered trademark) is used as a material of the protruding parts 12, a noise reduction by 3.7 dB was obtained compared to a case where no enclosure is installed. Moreover, when the seal member 14 is used as the protruding parts 12 at the extension parts 5, 7, 9 such as the discharge port 5, a noise reduction by 5.0 dB was obtained compared to a case where no enclosure is installed.

The effects and advantages of the present embodiment described above are as follows.

The main body 10 of the enclosure 1 is rigid to the degree that the main body 10 bends under its own weight and thus is deformable allowing for easier handling, and noise generated by the compressor 2 can be suppressed efficiently with a simple configuration.

Since the plurality of protruding parts 12 are in contact with the compressor 2, even when the main body 10 is rigid to the degree that the main body 10 bends under its own weight, the shape of the main body 10 can be maintained by being supported by the protruding parts 12. Further, since a space can be formed between the compressor 2 and the inner face of the main body 10 by the protruding parts 12, noise generated by the compressor 2 can be suppressed efficiently.

The compressor 2 is provided with the extension parts 5, 7, 9 extending externally out of the main body 10 of the enclosure 1, such as the discharge port 5 for discharging a refrigerant and the intake port 7 for taking in a refrigerant. The holes are formed in the main body 10 of the enclosure 1 so that the extension parts 5, 7, 9 are inserted therethrough. The seal member 14 is provided to the circumference of each of the holes as the protruding parts 12 that are in contact with the extension parts 5, 7, 9 of the compressor 2. Thus, noise leakage from the gaps between the main body 10 of the enclosure 1 and the extension parts 5, 7, 9 can be suppressed.

Because the protruding parts 12 are made of a softer material than the main body 10, transfer of vibrations generated by the compressor 2 to the main body 10 can be suppressed.

Because the main body 10 of the enclosure 1 is formed of the plurality of divided bodies 10A, 10B, this facilitates operation of assembling the enclosure 1 to surround the compressor 2.

The vibrations of the compressing unit 2A of the compressor 2 are larger than those of the electric motor unit 2B that drives the compressing unit 2A. Accordingly, more protruding parts 12 are provided to the motor unit 2B that generates relatively small vibrations and connected to the main body 10 of the enclosure 1. Thus, vibrations transferred to the main body 10 of the enclosure 1 can be suppressed.

Note that, although the protruding parts 12 are attached to the main body 10 of the enclosure 1 in the above embodiment, the main body 10 and the protruding parts 12 may be made of the same material and integrally molded.

The compressor-adapted enclosure and the compressor unit according to the embodiment described above are understood as follows, for example.

The compressor-adapted enclosure (1) according to the first aspect of the present disclosure includes: a main body (10) configured to accommodate and enclose a compressor (2) in the main body; and a plurality of protruding parts (12) protruding from an inner face of the main body, the plurality of protruding parts being in contact with the compressor, and the main body is rigid to the degree that the main body bends under its own weight.

The main body is rigid to the degree that the main body bends under its own weight and thus is deformable allowing easier handling, and noise generated by the compressor can be suppressed efficiently with a simple configuration.

Since the plurality of protruding parts are in contact with the compressor, even when the main body is rigid to the degree that the main body bends under its own weight, the shape of the main body can be maintained by being supported by the protruding parts. Further, since a space can be formed between the compressor and the inner face of the main body by the protruding parts, noise generated by the compressor can be suppressed efficiently.

As the material of the main body, a softer material than a rigid plastic material such as polypropylene (PP) and polybutylene terephthalate (PBT) is used, for example, a foaming resin material such as a foamed urethane (flexible PUR foam) can be used.

In the compressor-adapted enclosure according to the second aspect of the present disclosure, in the first aspect, a hole through which a part of the compressor is inserted so as to extend externally is formed in the main body, and a seal member (14) is provided to a circumference of the hole as one of the protruding parts.

The compressor is provided with the extension parts extending externally out of the main body of the enclosure, such as the discharge part for discharging a refrigerant and the intake part for taking in a refrigerant. The holes are formed in the main body of the enclosure so that the extension parts are inserted therethrough. The seal member is provided to the circumference of each of the holes as the protruding parts that are in contact with the extension parts of the compressor. Thus, noise leakage from the gaps between the main body of the enclosure and the extension parts can be suppressed.

In the compressor-adapted enclosure according to the third aspect of the present disclosure, in the second aspect, the protruding parts are made of a softer material than the main body.

Because the protruding parts are made of a softer material than the main body, transfer of vibrations generated by the compressor to the main body can be suppressed. As the material of the protruding parts, for example, a rubber sponge such as ethylene-propylene-diene rubber (EPDM) foam material of EPTSEALER (registered trademark) or the like, open-cell foam polyethylene, or the like can be used.

The compressor-adapted enclosure according to the fourth aspect of the present disclosure, in any of the first aspect to the third aspect, the main body is formed of a plurality of divided bodies (10A, 10B).

Because the main body is formed of the plurality of divided bodies, this facilitates operation of assembling the enclosure to surround the compressor. The number of divisions of the main body is preferably two.

In the compressor-adapted enclosure according to the fifth aspect of the present disclosure, in any of the first aspect to the fourth aspect, the protruding parts are more provided at positions corresponding to an electric motor unit of the compressor than at positions corresponding to a compressing unit of the compressor.

The vibrations of the compressing unit of the compressor are larger than those of the electric motor unit that drives the compressing unit. Accordingly, more protruding parts are provided to the electric motor unit that generates relatively small vibrations and connected to the main body of the enclosure. Thus, vibrations transferred to the main body of the enclosure can be suppressed. Note that, to relatively increase rigidity, the protruding parts may be provided to a plane perpendicular to the rotary shaft and passing through a main bearing (a bearing that rotatably supports the rotary shaft near the compressing unit) and/or on a plane passing through an end plate at the rear of a sub-bearing (a bearing that rotatably supports the rotary shaft on the opposite side to the main bearing).

The compressor unit of the present disclosure includes: the compressor-adapted enclosure according to any of the first aspect to the fifth aspect; and a compressor accommodated in the compressor-adapted enclosure.

REFERENCE SIGNS LIST

1 enclosure
2 compressor
2A compressing unit
2B motor unit (electric motor unit)
3 installation leg part
5 discharge port (extension part)
7 intake port (extension part)
9 wiring guide cylinder (extension part)
10 main body
10A, 10B half (divided body)
12 protruding part
14 seal member
P dividing face

The invention claimed is:

1. A compressor-adapted enclosure comprising:
a main body configured to accommodate and enclose a compressor in the main body; and
a plurality of protruding parts protruding from an inner face of the main body, the plurality of protruding parts being in contact with the compressor,
wherein the main body is rigid to the degree that the main body bends under its own weight, and
wherein the protruding parts are more provided at positions corresponding to an electric motor unit of the compressor than at positions corresponding to a compressing unit of the compressor.

2. The compressor-adapted enclosure according to claim 1,
wherein a hole through which a part of the compressor is inserted so as to extend externally is formed in the main body, and
wherein a seal member is provided to a circumference of the hole as one of the protruding parts.

3. The compressor-adapted enclosure according to claim 1, wherein the protruding parts are made of a softer material than the main body.

4. The compressor-adapted enclosure according to claim 1, wherein the main body is formed of a plurality of divided bodies.

5. A compressor unit comprising:
the compressor-adapted enclosure according to claim 1; and
a compressor accommodated in the compressor-adapted enclosure.

6. The compressor-adapted enclosure according to claim 2, wherein the protruding parts are made of a softer material than the main body.

* * * * *